US006290543B1

(12) United States Patent
Plummer, Jr. et al.

(10) Patent No.: US 6,290,543 B1
(45) Date of Patent: Sep. 18, 2001

(54) TELEPHONE ADAPTOR

(76) Inventors: Lawrence L. Plummer, Jr., P.O. Box 418, Forest Grove, PA (US) 18922; Paul R. Stepanoff, 1032 Apple Rd., Quakertown, PA (US) 18951

( * ) Notice: Subject to any disclaimer, the term of this patent is extended or adjusted under 35 U.S.C. 154(b) by 0 days.

(21) Appl. No.: 09/331,552

(22) PCT Filed: Dec. 18, 1997

(86) PCT No.: PCT/US97/23348

§ 371 Date: Jun. 18, 1999

§ 102(e) Date: Jun. 18, 1999

(87) PCT Pub. No.: WO98/27625

PCT Pub. Date: Jun. 25, 1998

Related U.S. Application Data

(60) Provisional application No. 60/033,612, filed on Dec. 19, 1996.

(51) Int. Cl.[7] ..... H01R 25/00

(52) U.S. Cl. ..... 439/639

(58) Field of Search ..... 439/639, 640, 439/535, 638, 626, 625, 502, 506, 214, 676

(56) References Cited

U.S. PATENT DOCUMENTS

| | | | | |
|---|---|---|---|---|
| 3,668,324 | | 6/1972 | Firestone | 179/1 PC |
| 4,290,664 | * | 9/1981 | Davis | 339/156 R |
| 4,362,905 | * | 12/1982 | Ismail | 179/1 PC |
| 4,497,526 | * | 2/1985 | Myers | 339/17 LC |
| 4,580,009 | * | 4/1986 | Darland | 179/2 C |
| 4,740,172 | | 4/1988 | Tubbs | 439/344 |
| 4,925,393 | | 5/1990 | Ingalsbe | 439/76 |
| 5,283,825 | | 2/1994 | Druckman et al. | 379/167 |
| 5,470,239 | | 11/1995 | Rancourt | 439/105 |
| 5,535,274 | | 7/1996 | Braitberg et al. | 379/446 |
| 5,706,160 | * | 1/1998 | Latuszkin | 361/119 |
| 5,775,946 | * | 7/1998 | Briones | 439/607 |
| 5,984,731 | * | 11/1999 | Laity | 439/676 |
| 6,058,184 | * | 3/2000 | Frank | 379/420 |

* cited by examiner

*Primary Examiner*—Gary Paumen
*Assistant Examiner*—Phuongchi Nguyen
(74) *Attorney, Agent, or Firm*—Webb Ziesenheim Logsdon Orkin & Hanson, P.C.

(57) ABSTRACT

A computer to telephone line interface includes a housing (2) having a base, a lid (22), a plurality of braces (26) formed integrally with the base and positioned between the base and the lid, and a plurality of sides (28) positioned between the base and the lid and between adjacent braces. A socket (12), preferably an RJ-11 jack, is disposed in a first one of the plurality of sides. A plug (10) is disposed in a second one of the plurality of sides. A pair of electrical conductors disposed inside the housing connect together a pair of contacts of the socket and a pair of contacts of the plug. The base and lid are separable to permit the plurality of sides to be selectively positioned between adjacent braces. The interface can include a connector having a pair of contacts connected to the pair of electrical conductors. In one embodiment, flexible conductive wires flexibly connected the connector and the housing. In another embodiment, the connector (16) is separate from the housing and receivable in the socket and a pair of clips (14) are connected to a pair of contacts of the connector via a pair of flexible conductive wires. In another embodiment, the connector is fixedly disposed in one of the plurality of sides.

17 Claims, 9 Drawing Sheets

TELEPHONE ADAPTOR

This application is a 371 of PCT/U.S. 97/23348 filed Dec. 18, 1997 and also claims benefit of provisional No. 60/033,612 filed Dec. 19, 1996.

BACKGROUND OF THE INVENTION

Adaptors for connecting computer modems, and other electrical equipment having RJ-11 type sockets, to telephone systems that utilize plugs/sockets other than the RJ-11 type are well known in the art cs illustrated in Magellan's Summer/Fall 1997 Catalog, USA; Toshiba 1997 Winter Accessories Catalog, USA; and TeleAdapt Limited UK Catalog. Moreover, electrical connectors for adapting electrical equipment having an RJ-11 type socket to a different type of electrical plug/socket are also known as shown in U.S. Pat. No. 4,362,905 to Ismail and U.S. Pat. No. 4,740,172 to Tubbs.

A problem with such adaptors, however, is that they only enable connection between plugs/sockets of two different telephone systems. Hence, a traveler visiting a plurality of different countries with, for example, a computer modem having an RJ-11 plug, would require a suitable plug/socket interface arrangement for each country that utilized a different standard plug/socket for its national telephone equipment. This is a problem because of the cost and inconvenience associated with purchasing a plurality of different pluglsocket interface arrangements, one for each country; the need to identify which plug/socket arrangement is utilized in each country; and the need to carry a plurality of plug/socket arrangements while traveling. Still another problem arises in having a traveler, who is potentially unfamiliar with telephone wiring, construct a plug/socket interface arrangement between different telephone systems.

It is therefore an object of the present invention to overcome the above problems and others by providing a telephone adaptor that enables connection between an RJ-11 socket and plugs/socket of a plurality of different telephone systems. It is a further object of the present invention to provide a telephone adaptor that includes protection circuitry to protect electrical equipment connected to the RJ-11 socket from line surges and voltage spikes. Finally, it is an object of the invention to provide a telephone adaptor that includes circuitry for detecting non-standard telephone line voltages and for providing an indication thereof.

SUMMARY OF THE INVENTION

Accordingly, I have invented a telephone adaptor that includes a first connector utilized in connection with a first national telephone system, a plug utilized in connection with a second national telephone system and a second connector utilized in connection with a third national telephone system. A plurality of electrical conductors electrically connect in parallel a plurality of contacts of the first connector, a plurality of contacts of the plug and a plurality of contacts of the second connector. A housing secures the first connector, the plug and the second connector relative to each other.

Preferably, the housing includes a base and a lid positioned in opposition by a plurality of braces. The plurality of braces are disposed between a periphery of the base and a periphery of the lid. A plurality of sides are selectively positioned between pairs of adjacent braces. The first connector, the plug and the second connector are disposed in at least two different sides of the housing.

The telephone adapter can include a surge protector connected between a pair of the electrical conductors; a surge protector connected between one of the electrical conductors and an electrical ground reference; an LED connected between a pair of electrical conductors; and/or a fuse disposed in series with one of the plurality of electrical conductors. The plurality of electrical conductors can include flexible conductive wires disposed through a side of the housing and connected to one of the first connector, the plug and/or the second connector.

The telephone adaptor can include a third connector separate from the housing and mateable with the first connector so that a plurality of contacts of the third connector and the plurality of contacts of the first connector are electrically connected in parallel. A plurality of clips can be electrically connected to the plurality of contacts of the third connector via the electrical conductors. The electrical conductors extending between the third connector and the plurality of clips are flexible conductive wires that flexibly secure together the third connector and the plurality of clips.

An advantage of the present invention is that it provides a single telephone adaptor for connecting electrical equipment having an RJ-11 socket to a plurality of different sockets or plugs associated with different national telephone systems.

Another advantage of the present invention is that the telephone adaptor includes protection circuitry for protecting electrical equipment connected thereto from electrical spikes on the telephone lines.

Still another advantage is that the telephone adaptor includes a non-standard voltage detector for detecting the presence of non-standard telephone line voltages and providing an indication thereof.

Still another advantage is that different types of plugs/sockets can be utilized in the housing of the present invention.

Still other advantages will become apparent upon reading and understanding the following detailed description. dr

DETAILED DESCRIPTION OF THE PREFERRED EMBODIMENT

Figure 1A:
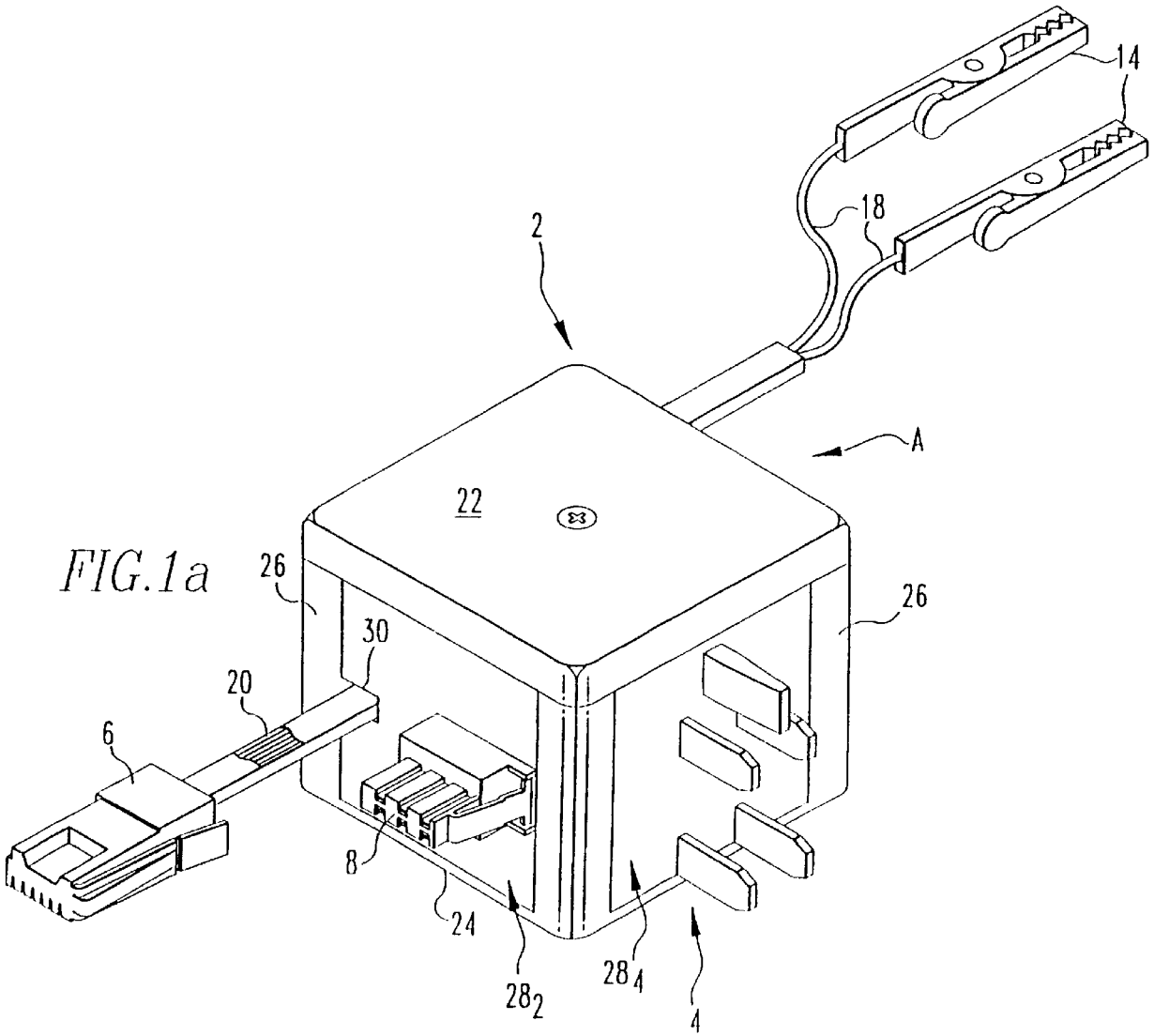
FIGS. 1*a* an 1*b* are perspective views of a telephone adaptor in accordance with the present invention including sockets for one national telephone system and plugs for different national telephone systems.
Figure 1B:
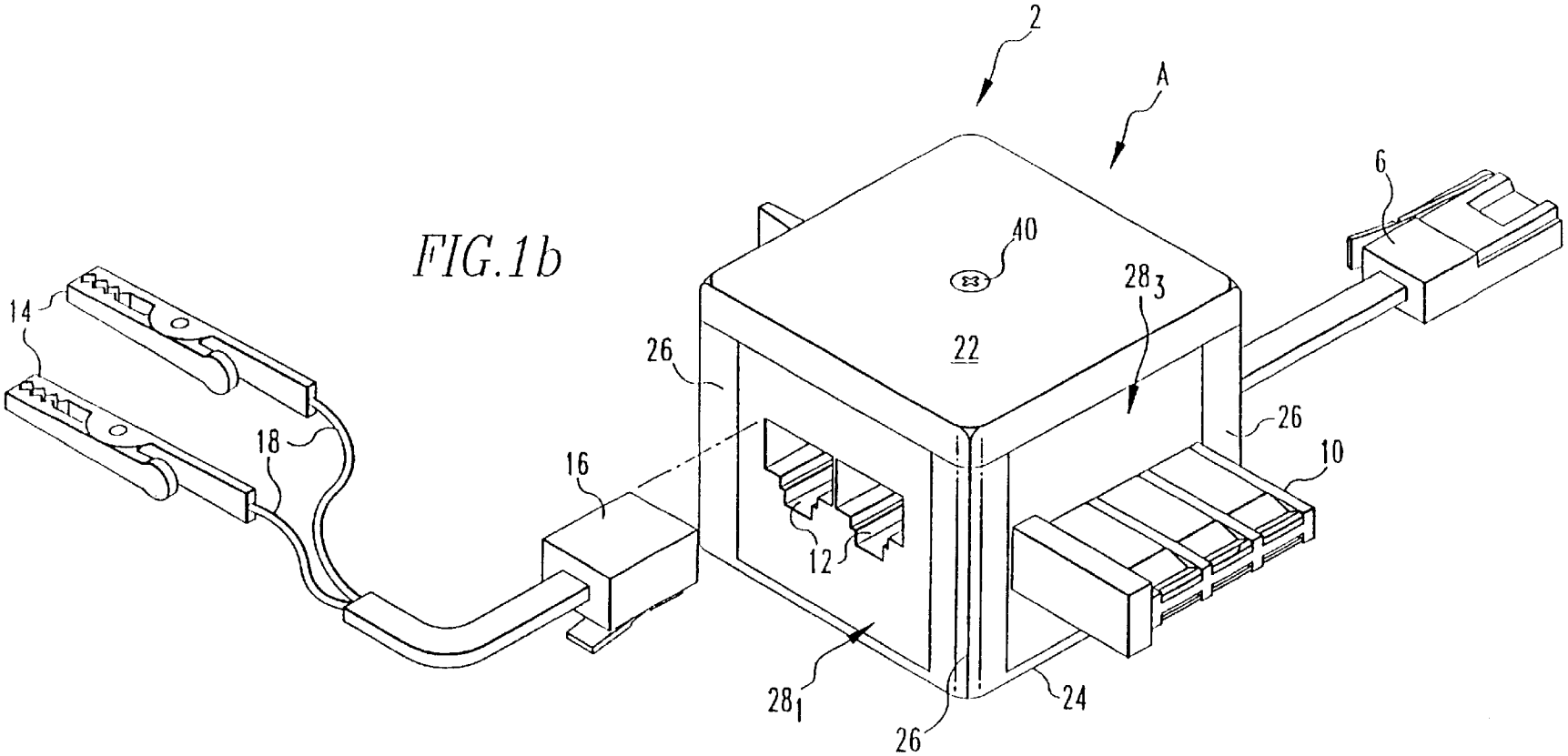

With reference to FIGS. 1*a* and 1*b*, a universal telephone adaptor A includes a Cute shaped housing 2 which includes a plurality of different telephone connectors. In one embodiment, these telephone connectors include a plug 4 for the telephone system in the Commonwealth of Independent States (CIS) or Russia, a plug 6 for the telephone system in the United Kingdom, a plug 8 for the telephone system in Germany, a plug 10 for the telephone system in France and a pair of sockets 12 for the telephone system in the United States. One or more of the plugs 4, 6, 8 or 10 can be replaced with a plug (not shown) for another telephone system. Hereinafter, plugs 4, 6, 8 and 10 are collectively referred to as "Telephone Plugs". The Telephone Plugs can be enclosed within the housing 2 or flexibly connected to the housing 2 by a cord or wires, such as wires 20 connected to plug 6.

If a telephone system is encountered that does not utilize one of the provided Telephone Plugs or sockets 12, spring loaded clips 14 are provided which are electrically connected to contacts (not shown) of a plug 16 which is receivable in one of the sockets 12 having mating contacts. In use, the clips 14 are connected directly to exposed conductors of the telephone system. To expose such conductors, it may be necessary to remove a wall plate and/or strip away conductor insulation frog the conductors. When the clips 14 are connected, electrical continuity is established via the plug 16 received in one of the sockets 12.

Figure 2:
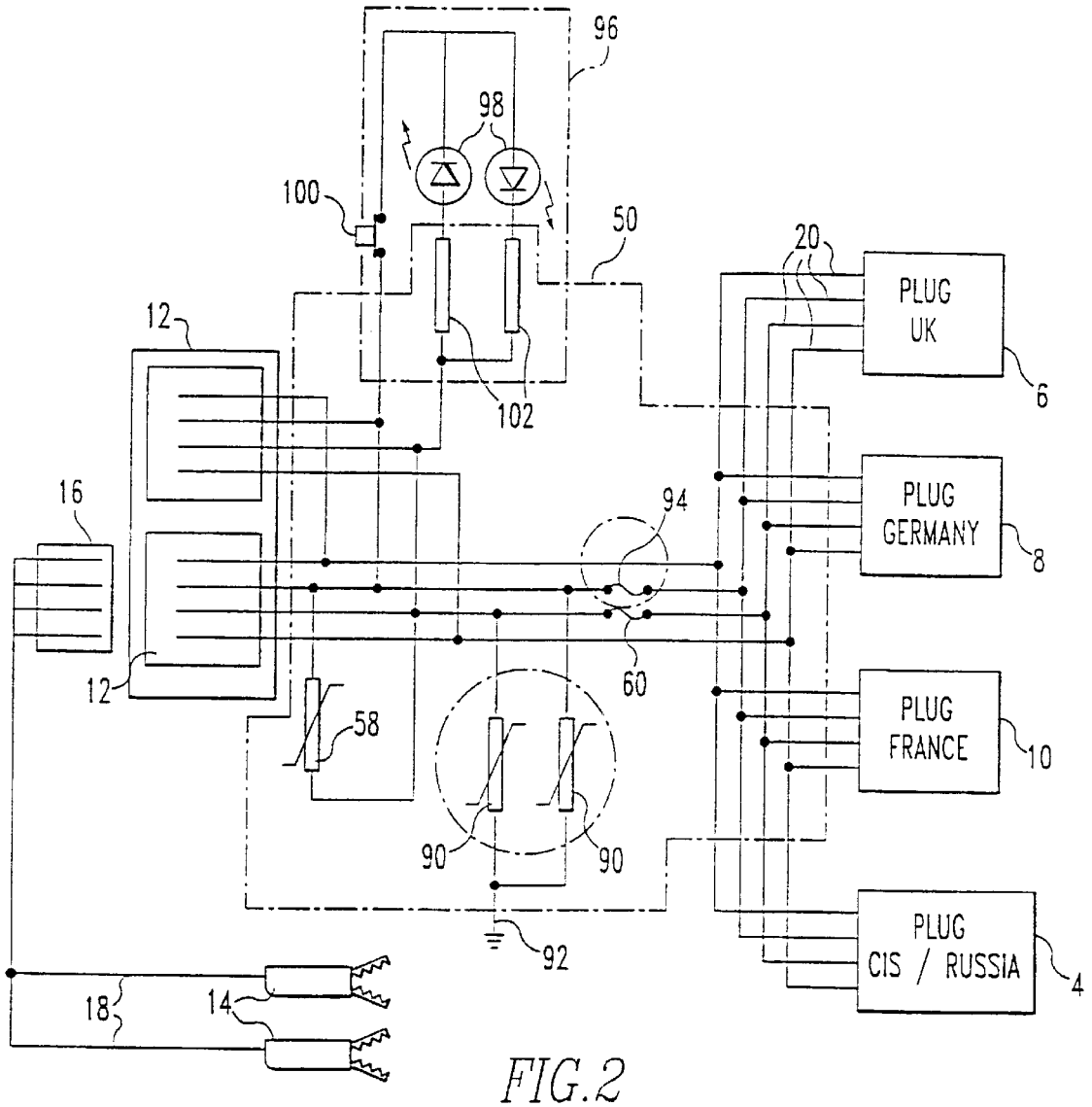
FIG. 2 is an electrical diagram of the interconnection of the contacts associated with the sockets and plugs of the telephone adaptor of FIGS. 1*a* and 1*b;*

With reference to FIG. 2 and with continuing reference to FIGS. 1*a* and 1*b*, the housing 2 preferably includes the sockets 12, preferably RJ-11 jacks, having their contacts parallel connected with suitable contacts of each of the Telephone Plugs. The housing 2 preferably includes a pair of sockets 12, however, the housing can include only one socket 12.

The housing 2 includes a lid 22 and a base 24 positioned in opposition by a plurality of braces 26, preferably disposed between a periphery of the base 24 and a periphery of the lid 22. The housing 2 includes a plurality of sides $\mathbf{28}_1$–$\mathbf{28}_4$, each of which preferably includes one or more of the Telephone Plugs or sockets 12 disposed therein. One or more of the sides $\mathbf{28}_1$–$\mathbf{28}_4$ can also include a slot 30 adapted to receive and grasp flexible conductive wires, e.g., wires 20, connected between the housing 2 and a plug, e.g., plug 6.

Figure 3A:
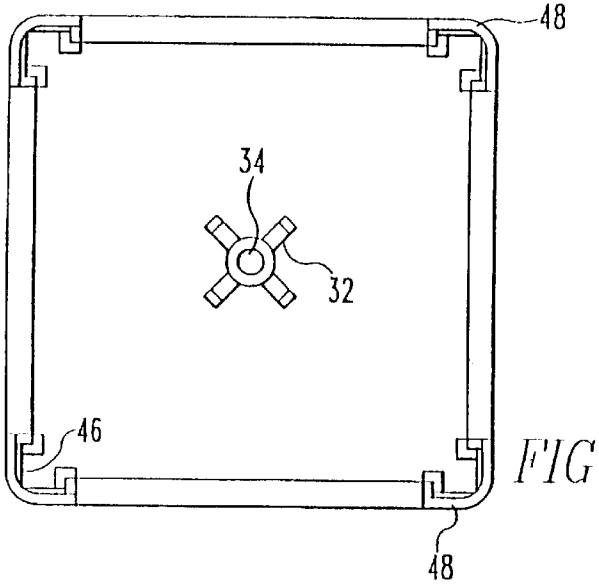
FIGS. 3*a* and 3*b* are respective plan and elevational views of the base of the telephone adaptor of FIGS. 1*a* and 1*b;*
Figure 3B:
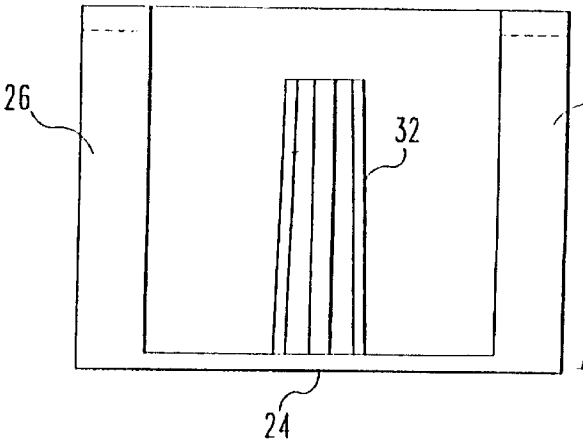

With reference to FIGS. 3*a* and 3*b*, the base 24 of the housing 2 preferably has a generally square or rectangular outline and each corner of the base 24 includes one of the braces 26, preferably formed integrally therewith. Positioned in a central part of the base 24 is a mounting post 32 that preferably extends parallel with the braces 26. The mounting post 32 includes a threaded receiving aperture 34 coaxial with a lengthwise axis of the mounting post 32 at an end thereof opposite the base 24.

Figure 4A:
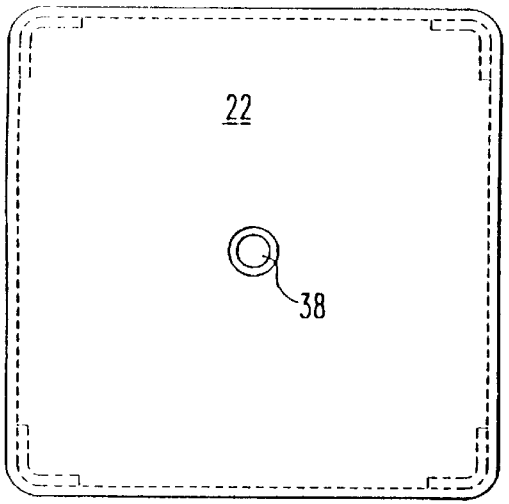
FIGS. 4*a* and 4*b* are respective plan and elevational views of the lid of the telephone adaptor of FIGS. 1*a* and 1*b;*
Figure 4B:
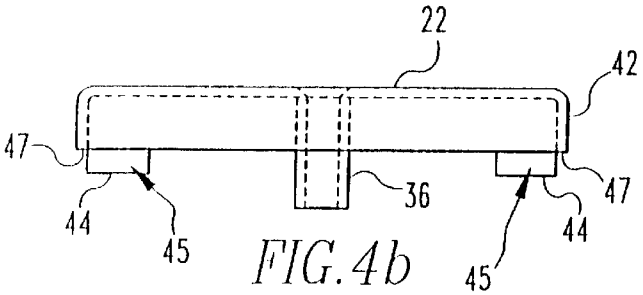
Figure 5C:
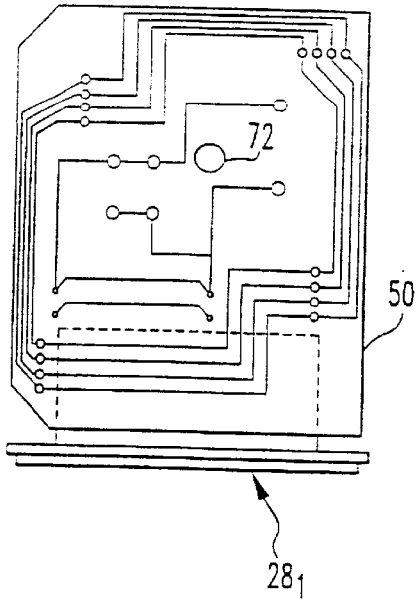
FIGS. 5*a*–5*d* are isolated views of the respective front, side, top and bottom of one of the sides of the telephone adaptor of FIGS. 1*a* and 1*b* including RJ-11 telephone sockets utilized in the United States.
Figure 5B:
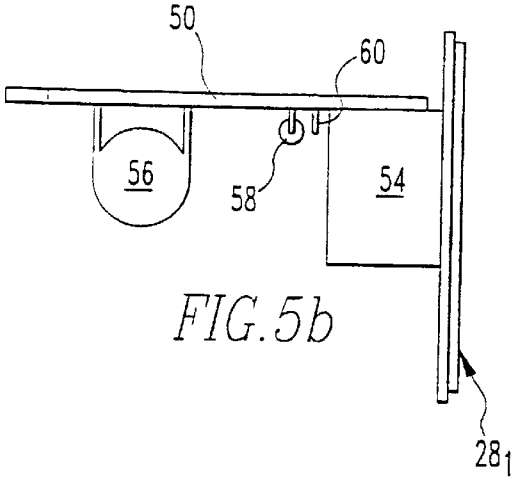
Figure 5A:
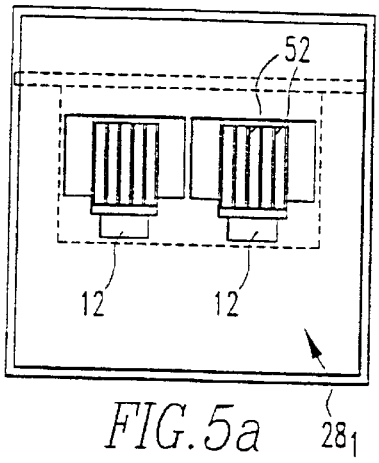
Figure 5D:
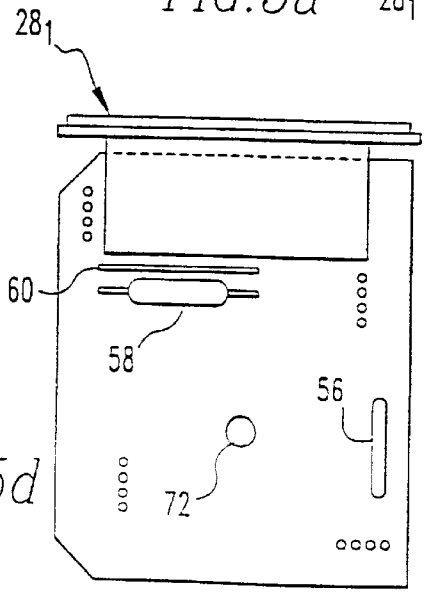

With reference to FIGS. 4*a* and 4*b* and with ongoing reference to FIGS. 1*a* and 1*b* and FIGS. 3*a* and 3*b*, the lid 22 includes a cylindrical standoff 36 extending from a central part of the lid 22. The standoff 36 has an inside diameter 38 of sufficient extent to receive a shaft of a screw 40. The lid 22 preferably has a generally rectangular outline and includes a lip 42 formed around the periphery of the lid 22. The lip 42 extends from the periphery of the lid 22 in the same direction as the standoff 36. Each corner of the lid 22 is rounded and includes an arcuate shaped guide 44 positioned adjacent the inside surface of the lip 42 and extending beyond a lower edge 47 of the lip 42. The outer surface 45 of each guide 44 and the inner surface 46 of each brace 26 opposite the base 24 are adapted to mate. Mating the outer surfaces 45 of the guides 44 and the inner surfaces 46 of the braces 26 aligns the lid 22 and the braces 26 so that the edge 47 of the lip 42 adjacent each corner of the lid 22 contacts ends 48 of the braces 26 opposite the base 24.

With reference to FIGS. 5*a*–5*d*, a printed circuit board 50 is preferably secured at a right angle to the side $\mathbf{28}_1$ having the sockets 12 disposed therein. More specifically, the sockets 12 each include a plurality of contacts 52 therein. A proximal end of each contact 52 extends through a socket housing 54, preferably formed integrally with the side $\mathbf{28}_1$, and is soldered into a through-hole (not shown) in the printed circuit board 50. A plurality of electrical conductors 55, formed on the printed circuit board 50 and electrically connected to the through-holes thereof, parallel connect the contacts 52 of the pair of sockets 12. The printed circuit board 50 can also receive electronic components, such as a surge protector 56, e.g., a varistor, and/or a fuse 58. A jumper 60 can be provided in one of the electrical conductors of the printed circuit board 50 in the absence of a fuse 58.

Figure 6B:
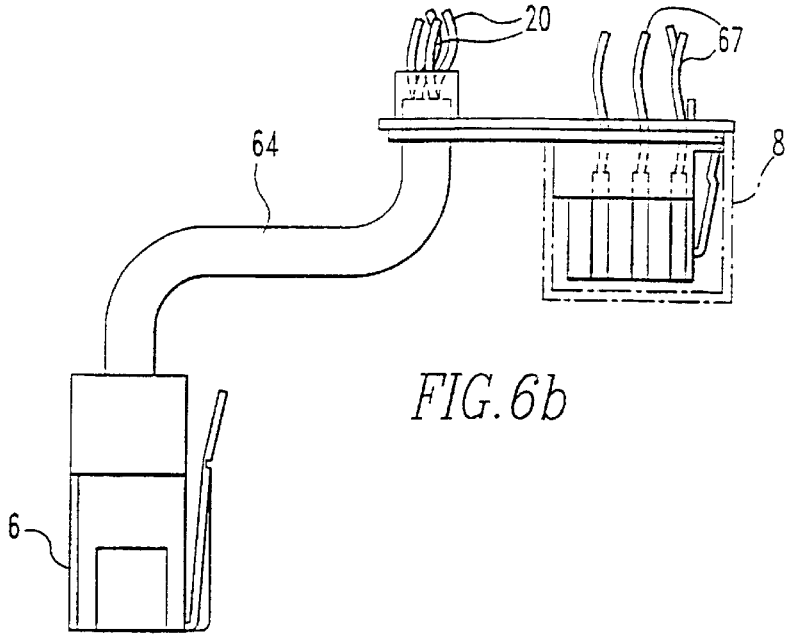
FIGS. 6*a*–6*c* are isolated views of the respective front, top and side of one of the sides of the telephone adaptor in FIGS. 1*a* and 1*b* including plugs for use with telephone systems in the United Kingdom and Germany.
Figure 6A:
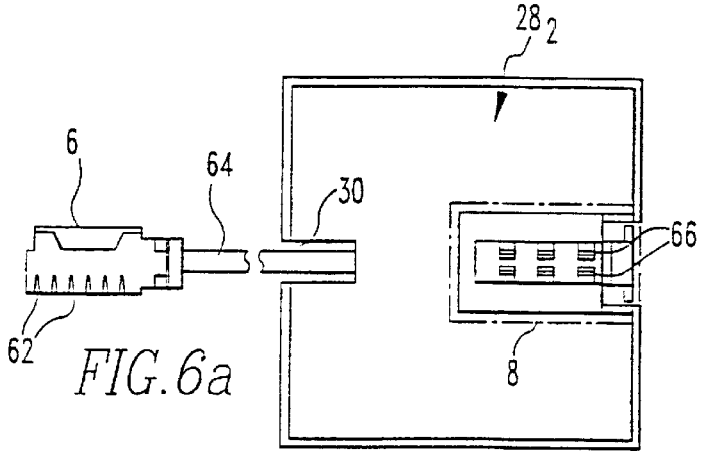
Figure 6C:
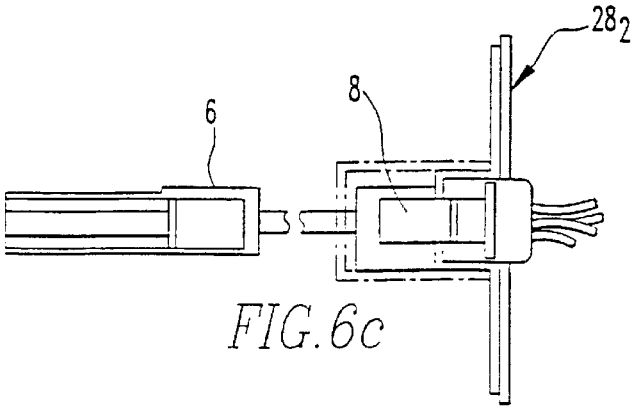

With reference to FIGS. 6*a*–6*c*, a plurality of contacts 62 are positioned at a distal end of the plug 6 disposed through the side 282. The contacts 62 are electrically connected to the electrical conductors 55 on the printed circuit board 50 via the conductors 20 which are disposed in a sheath 64 between the plug 6 and the slot 30 formed in the side $\mathbf{28}_2$. More specifically, the ends of the conductors 20 opposite the plug 6 are electrically connected to electrical conductors 55 on the printed circuit board 50 which parallel connect the contacts 62 of the plug 6 and the contacts 52 of the sockets 12.

A plurality of contacts 66 are positioned at a distal end of the plug 8 disposed in the side $\mathbf{28}_2$. The contacts 66 are electrically connected to electrical conductors 55 on the printed circuit board 50 via conductors 67 connected therebetween. The electrical conductor 55 on the printed circuit board 50 parallel connect the contacts 66 of the plug 8 and the contacts 52 of the sockets 12.

Figure 7A:
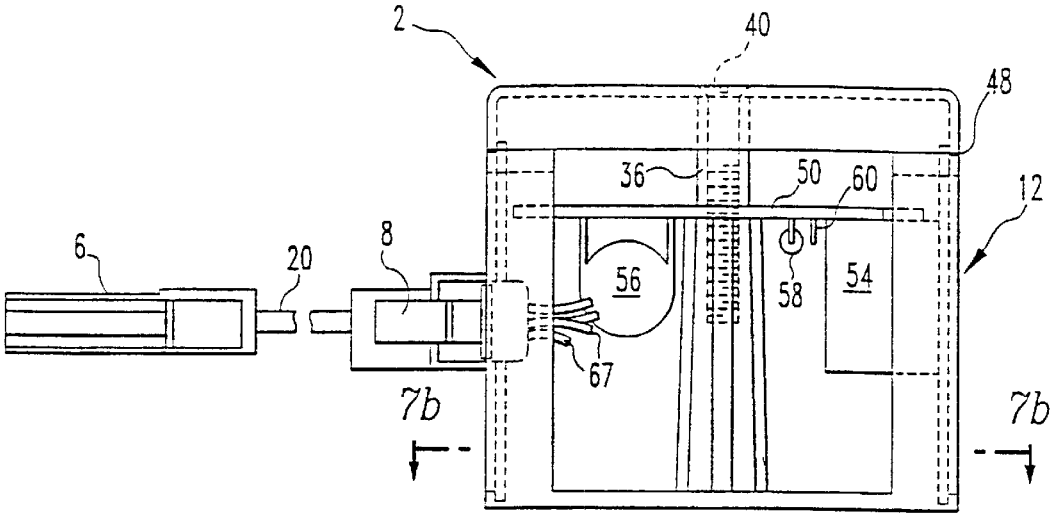
FIG. 7*a* is a partially assembled elevational view of the telephone adaptor of FIGS. 1*a* and 1*b;*
Figure 7B:
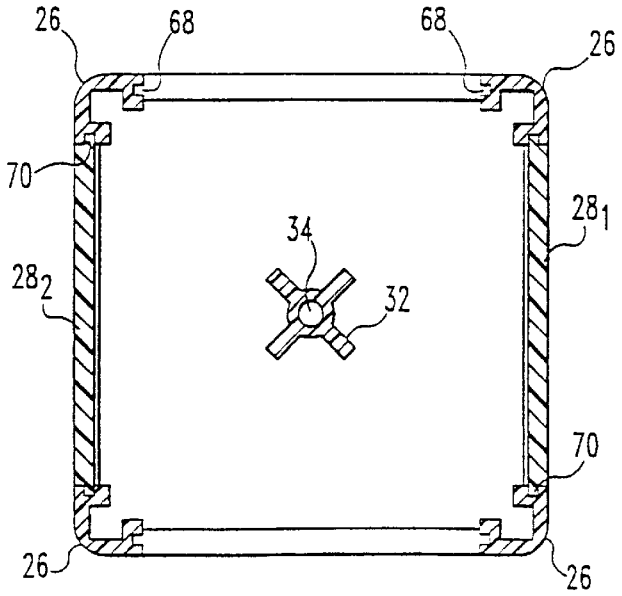
FIG. 7*b* is a cross-sectional view of the partially assembled telephone adaptor taken along lines 7*b*–7*b* in FIG. 7*a;*
Figure 8C:
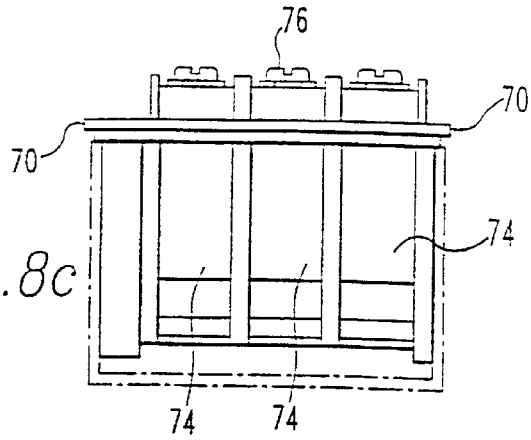
FIGS. 8*a*–8*d* are isolated views of the respective front, side, top and back of one of the sides of the telephone adaptor in FIGS. 1*a* and 1*b* including a telephone plug for use with the telephone system in France.
Figure 8B:
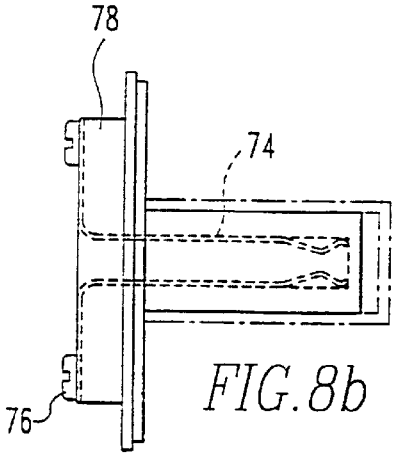
Figure 8A:
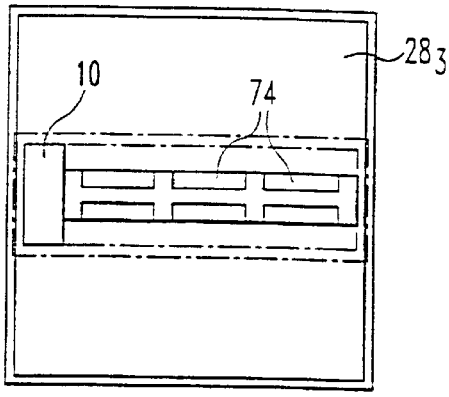
Figure 8D:
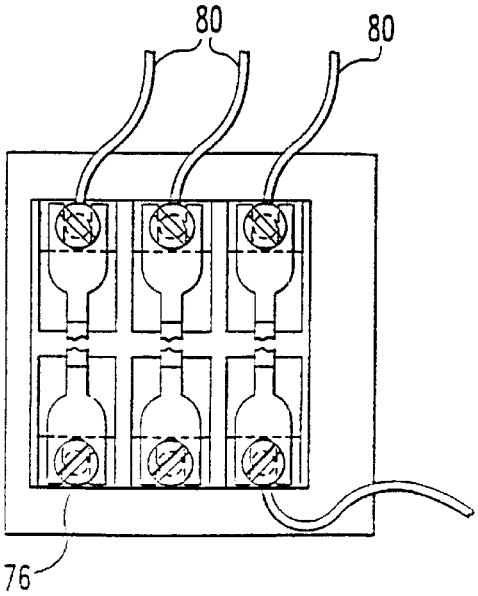
Figure 9D:
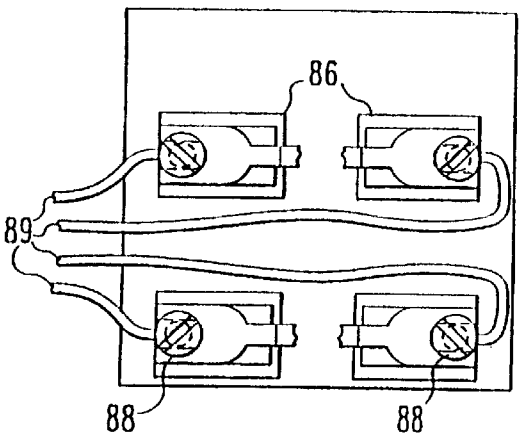
FIGS. 9*a*–9*d* show isolated views of the respective front, side, top and back views of one of the sides of the telephone adaptor in FIGS. 1*a* and 1*b* including a telephone plug for use with telephones system in the Commonwealth of Independent States or Russia.
Figure 9C:
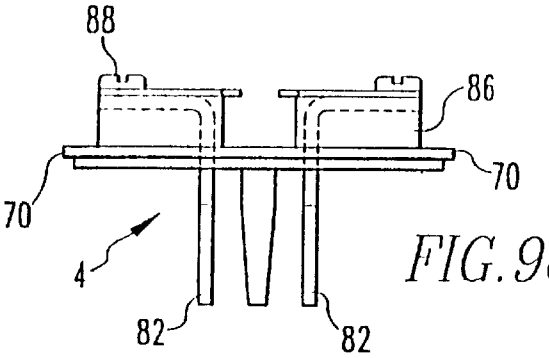
Figure 9A:
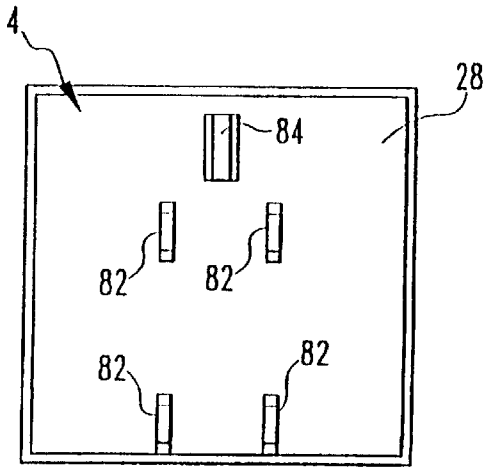
Figure 9B:
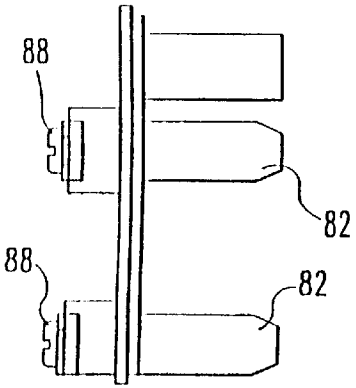

With reference to FIGS. 7*a* and 7*b*, the sides $\mathbf{28}_1$–$\mathbf{28}_2$, including sockets 12, and connectors 6, 8, respectively, are positioned between adjacent braces 26 on opposite sides of the housing 2. Each brace 26 includes, on opposite sides thereof, a lengthwise receiving slot or groove 68 which extends between the base 24 and the end 48 opposite the base 24. The edges of the sides $\mathbf{28}_1$–$\mathbf{28}_4$ each include a tongue 70 that is receivable in one of the grooves 68. The side $\mathbf{28}_1$, including the sockets 12, is positioned between adjacent braces 26 so that a mounting hole 72 (FIG. 5*d*) in the printed circuit board 50 is aligned with the threaded receiving aperture 34 of the mounting post 32. The side of the printed circuit board 50 having the components 56, 58 and 60 thereon is preferably positioned so that it faces the mounting post 32. The side $\mathbf{28}_2$, including the plugs 6, 8, is positioned between adjacent braces 26 and the conductors 20 and 67, respectively, are disposed inside the housing 2 between the printed circuit board 50 and the base 24. Positioning the lid 22 on the ends 48 of the braces 26 opposite the base 24 aligns the cylindrical standoff 36, the mounting hole 72 and the threaded receiving aperture 34 to receive the screw 40 therethrough. Preferably, the cylindrical standoff 36 and the mounting post 32 sandwich The printed circuit board 50 therebetween.

To receive each side $\mathbf{28}_1$–$\mathbf{28}_4$ between adjacent braces 26, the tongues 70 on opposite sides of each side $\mathbf{28}_1$–$\mathbf{28}_4$ is aligned with opposing grooves 68. Each side $\mathbf{28}_1$–$\mathbf{28}_4$ are then moved towards the base 24 so that the tongues 70, on opposite sides of each side $\mathbf{28}_1$–$\mathbf{28}_4$, are slidably received in opposing grooves 68 of adjacent braces 26.

With reference to FIGS. 8*a*–8*d*, a plurality of contacts 74 are disposed on a distal end of the plug 10 disposed in the side $\mathbf{28}_3$. A proximal end of each contact 74 is secured by a screw 76 to a terminal block 78 formed integrally on an inside surface of the side $\mathbf{28}_3$. The contacts 74 are parallel connected with contacts of the sockets 12 via conductors 80 extending between the screws 76 and the electrical conductors 55 on the printed circuit board 50.

With reference to FIGS. 9*a*–9*d*, the plug 4 includes a plurality of spade lug contacts 82 which project through the side $\mathbf{28}_4$. The plug 4 also includes an alignment key 84 integrally formed in an outside surface of the side $\mathbf{28}_4$. The alignment key 84 is positioned to mate with an alignment aperture in a receiving socket (not shown) to avoid misorientation of the spade lug contacts 82 with mating contacts of the receiving socket. Each spade lug contact 82 has a proximal end connected by a screw 88 to a terminal block 86 formed integrally on an inside surface of the side $\mathbf{28}_4$. The spade lug contacts 82 are parallel connected with contacts of the sockets 12 via conductors 89 extending between the screws 88 and the electrical conductors 55 of the printed circuit board 50.

Because each side $\mathbf{28}_1$–$\mathbf{28}_4$ is slidably receivable between adjacent braces 26, the order of sides $\mathbf{28}_1$–$\mathbf{28}_4$ around housing 2 can be selected whereby the Telephone Plugs and the sockets 12 can be positioned as desired around housing 2. Moreover, other connectors can be substituted for one or more of the Telephone Plugs or the sockets 12 shown. Similarly, blank sides 28, not having a plug and/or socket, can replace one or more of the sides $\mathbf{28}_1$–$\mathbf{28}_4$ including the Telephone Plugs or the sockets 12. Hence, the telephone adaptor A can be adaptively configured to include selected connectors thereby avoiding unnecessary cost associated with providing undesired connectors. When the sides $\mathbf{28}_1$–$\mathbf{28}_4$ containing the Telephone Plugs and sockets 12 are suitably arranged, the lid 22 is positioned on the ends of the braces 26 opposite the base 24 as shown in FIG. 7*a*. Thereafter, a threaded end of screw 40 is mated with the threads of the threaded receiving aperture 34 to secure the housing 2 together.

In the above described embodiment, the sockets 12 and the printed circuit board 50 are rigidly connected together by soldering proximal ends of contacts 52 to through-holes in the printed circuit board 50. However, the contacts 52 can be electrically connected to the conductive lines on the printed circuit board 50 via flexible conductors (not shown). In an embodiment where the printed circuit board 50 is not rigidly secured to one of the sides $\mathbf{28}_1$–$\mathbf{28}_4$, the sandwiching of the printed circuit board 50 between the mounting post 32 and the cylindrical standoff 36 is sufficient to secure the position of the printed circuit board 50 inside the housing 2.

With reference back to FIG. 2, the printed circuit board 50 can include the surge protector 56, such as a varistor, connected between a pair of electrical conductors 55 on the printed circuit board 50. Moreover, the fuse 58 can be installed in series with one of the electrical conductors 55 on the printed circuit board 50 to avoid excessive current flowing therethrough. The printed circuit board 50 can also include a pair of surge protectors 90 connected between a pair of electrical conductors 55 on the printed circuit board 50. In this embodiment, a junction of the pair of surge protectors go is connected to an earth or reference ground 92. The surge protectors 56 and 90 are selected to protect electrical equipment, such as a computer, connected to the telephone line via one of the sockets 12 or Telephone Plugs from potentially damaging voltage spikes. Moreover, one or more additional fuses 94 can be connected in series with another one of the electrical conductors 55 on the printed circuit board 50 to avoid excessive current flowing therethrough.

A standard analog phone line has 24 voltage impressed on certain conductors. In contrast, some non-standard phone lines, such as digital phone lines, utilize higher voltages, e.g., 100 volts. These higher voltages are potentially damaging to electrical devices designed to interface With the standard phone line. To provide an indication when a non-standard phone line voltage is encountered, a circuit 96 is connected between a pair of electrical conductors 55 on the printed circuit board 50. The circuit 96 includes one or more LEDs 98 electrically connected between the pair of electrical conductors 55 on the printed circuit board 50. A switch 100 is provided between the LEDs 99 and one of the pair of electrical conductors to selectively permit a non-standard voltage test to be conducted. To limit the current through the one or mere LEDs 98 resistors 102 are provided in series therewith. Preferably, the one or more LEDs 98 and the switch 100 are positioned to be viewed and activated, respectively, from outside the housing 2. Activating the switch 100 in the presence of a non-standard voltage causes the one or more LEDs 98 to illuminate and alert of a non-standard phone line voltage. Hence, non-standard phone line voltages can be detected prior to connecting electrical equipment to one or more of the Telephone Plugs or sockets 12.

The invention has been described with reference to the preferred embodiments. Obvious modifications and alterations will occur to others upon reading and understanding the preceding detailed description. For example, while each Telephone Plug and/or socket 12 preferably has four parallel connected contacts, one or more of the Telephone Plugs and/or sockets 12 may only have two or three contacts connected in parallel with contacts of the other Telephone Plugs and/or sockets 12. Moreover, while described in connection with a cube shaped housing, the housing could have a circular, oval, triangular or other shape. Further, the position of the plugs/sockets in the sides of the housing is not limited to the four sides shown. Moreover, while the present invention has been shown in connection with connectors formed integrally with the sides of the housing, each side of the housing can be adapted to receive one or more connectors formed separate from the sides. It is intended that the invention be construed as including all such modifications and alterations.

What is claimed is:

1. A telephone adaptor comprising:

a housing;

a first connector utilized in connection with a first national telephone system, the first connector being one of a first plug or a first socket which is configured to mate with a first mating connector which is detached from the housing and which is the other of the first plug or the first socket;

a second connector utilized in connection with a second national telephone system, the second connector being one of a second plug or a second socket which is configured to mate with a second mating connector which is detached from the housing and which is the other of the second plug or the second socket;

a third connector utilized in connection with a third national telephone system, the third connector being one of a third plug or a third socket which is configured to mate with a third mating connector which is detached from the housing and which is the other of the third plug or the third socket; and a plurality of electrical conductors electrically connecting in parallel a plurality of contacts of the first connector, a plurality of contacts of the second connector and a plurality of contacts of the third connector, wherein:

the housing secures the first connector, the second connector and the third connector relative to each other;

the first connector is not configured to mate with the second connector, the second mating connector, the third connector and the third mating connector;

the second connector is not configured to mate with the first connector, the first mating connector, the third connector and the third mating connector;

the third connector is not configured to mate with the first connector, the first mating connector, the second connector and the second mating connector;

the plurality of electrical conductors include flexible conductive wires disposed through a side of the housing; and at least one of the first connector, the second connector and the third connector includes a connector body which is spaced from the housing and flexibly connected thereto by the flexible conductive wires.

2. A telephone adaptor comprising:

a housing;

a first connector utilized in connection with a first national telephone system, the first connector being one of a first plug or a first socket which is configured to mate with a first mating connector which is detached from the housing and which is the other of the first plug or the first socket;

a second connector utilized in connection with a second national telephone system, the second connector being one of a second plug or a second socket which is configured to mate with a second mating connector which is detached from the housing and which is the other of the second plug or the second socket;

a third connector utilized in connection with a third national telephone system, the third connector being one of a third plug or a third socket which is configured to mate with a third mating connector which is detached from the housing and which is the other of the third plug or the third socket; and a plurality of electrical conductors electrically connecting in parallel a plurality of contacts of the first connector, a plurality of contacts of the second connector and a plurality of contacts of the third connector, wherein:

the housing which secures the first connector, the second connector and the third connector relative to each other;

the first connector is not configured to mate with the second connector, the second mating connector, the third connector and the third mating connector;

the second connector is not configured to mate with the first connector, the first mating connector, the third connector and the third mating connector;

the third connector is not configured to mate with the first connector, the first mating connector, the second connector and the second mating connector; and at least one of the first connector, the second connector and the third connector is (i) integral with a side of the housing or is (ii) spaced from the housing and flexibly connected thereto by flexible conductive wires disposed through a side of the housing.

3. A telephone adaptor comprising:

a housing;

a first connector utilized in connection with a first national telephone system, the first connector being one of a first plug or a first socket which is configured to mate with a first mating connector which is detached from the housing and which is the other of the first plug or the first socket;

a second connector utilized in connection with a second national telephone system, the second connector being one of a second plug or a second socket which is configured to mate with a second mating connector which is detached from the housing and which is the other of the second plug or the second socket;

a third connector utilized in connection with a third national telephone system, the third connector being one of a third plug or a third socket which is configured to mate with a third mating connector which is detached from the housing and which is the other of the third plug or the third socket; and a plurality of electrical conductors electrically connecting in parallel a plurality of contacts of the first connector, a plurality of contacts of the second connector and a plurality of contacts of the third connector, wherein:

the housing secures the first connector, the second connector and the third connector relative to each other;

the first connector is not configured to mate with the second connector, the second mating connector, the third connector and the third mating connector;

the second connector is not configured to mate with the first connector, the first mating connector, the third connector and the third mating connector;

the third connector is not configured to mate with the first connector, the first mating connector, the second connector and the second mating connector;

the housing has a plurality of sides;

the first connector, the second connector and the third connector are disposed in at least two different sides of the housing;

the housing includes a base and a lid positioned in opposition by a plurality of braces;

the plurality of braces disposed between a periphery of the base and a periphery of the lid;

each side is positionable between a pair of adjacent braces; and the order of the plurality of sides around the housing is selectable.

4. The telephone adaptor as set forth in claim 3, wherein:

each edge of each of the plurality of sides includes a tongue;

each side of each brace includes a groove that extends between the base and the lid;

the grooves of adjacent braces are positioned in opposition; and tongues on opposite edges of each side are receivable in opposing grooves.

5. The telephone adaptor as set forth in claim 3, wherein:

the base of the housing is rectangular; and each corner of the base includes a brace.

6. The telephone adaptor as set forth in claim 3, wherein the braces are formed integrally with the base.

7. The telephone adaptor as set forth in claim 3, further including at least one of:

(i) a surge protector connected between a pair of the electrical conductors;

(ii) a surge protector connected between a pair of the plurality of electrical conductors and an electrical ground reference;

(iii) an LED connected between a pair of the electrical conductors; and (iv) a fuse disposed in series with one of the plurality of electrical conductors.

8. The telephone adaptor as set forth in claim 3, wherein the first connector and the second connector are each positionable in different sides of the housing.

9. The telephone adaptor set forth in claim 3, wherein each electrical conductor includes:

a conductive line formed on a printed circuit board disposed inside the housing; and a conductive wire electrically connected between the conductive line and one of the plurality of contacts of at least one of the first connector, the second connector and the third connector.

10. The telephone adaptor as set forth in claim 9, further including a mounting post fixedly disposed inside the housing, wherein:

the mounting post has a threaded receiving aperture;

the printed circuit board includes a mounting hole formed therein; and the printed circuit board is positionable inside the housing so that a threaded screw projected through the mounting hole is threadedly received in the threaded receiving aperture for securing the printed circuit board to the mounting post.

11. A telephone line interface comprising:

a housing having a base, a plurality of sides that are selectively positionable around the base, and a lid receivable on the plurality of sides opposite the base;

a plurality of electrical conductors disposed inside the housing;

a socket integral with one of the plurality of sides and having a plurality of contacts connected in parallel with the plurality of electrical conductors; and one or more plugs, each plug having a plurality of contacts connected in parallel with the plurality of electrical conductors, each plug one of (i) integral with one of the plurality of sides other than the side having the socket and (ii) spaced from the housing and flexibly connected thereto via the plurality of electrical conductors extending through one of the plurality of sides other than the side having the socket wherein of the one or more plugs and the socket relative to the base can be adjusted by selectively positioning the plurality of sides around the base.

12. The interface as set forth in claim 11, further including at least one of:

(i) a surge protector connected between two of the electrical conductors;

(ii) a surge protector connected between one of the plurality of electrical conductors and an electrical ground reference;

(iii) an LED connected between two of the electrical conductors; and (iv) a fuse disposed in series with one of the electrical conductors.

13. A telephone line interface comprising:

a housing having a base, a plurality of sides that are selectively positionable around the base, and a lid receivable on the plurality of sides opposite the base;

a first connector integral with a first one of the sides and configured to mate with a first mating connector which is detached from the housing;

a second connector integral with a second one of the sides and configured to mate with a second mating connector which is detached from the housing;

a third connector coupled to one of the plurality of sides and configured to mate with a third mating connector which is detached from the housing; and a pair of electrical conductors disposed between the base, the plurality of sides and the lid and electrically connecting in parallel a pair of contacts of the first connector, a pair of contacts of the second connector and a pair of contacts of the third connector, wherein:

an order of the first connector and the second connector relative to the base can be adjusted by selectively positioning the plurality of sides around the base;

the pair of electrical conductors include flexible conductive wires disposed through the side of the housing having the third connector coupled thereto; and the third connector includes a connector body which is spaced from the housing and which is flexibly coupled to the housing by the flexible conductive wires.

14. The interface as set forth in claim 13, wherein the first connector, second connector and third connector are each utilized with a different national telephone system.

15. The interface as set forth in claim 13, further including at least one of;

(i) a surge protector connected between the pair of electrical conductors;

(ii) a surge protector electrically connected between one of the pair of electrical conductors and an electrical ground reference;

(iii) an LED connected between the pair of electrical conductors; and (iv) a fuse connected in series with one the electrical conductors.

16. The interface as set forth in claim 13, wherein the third mating connector includes a connector body and a pair of clips spaced from the connector body and connected to a pair of contacts disposed in the connector body by a pair of flexible conductive wires.

17. The interface as set forth in claim 13, further including a fourth connector (i) integral with one of the plurality of sides, or (ii) spaced from the housing, the fourth connector having a pair of contacts electrically connected to the pair of electrical conductors, wherein when the fourth connector is spaced from the housing, the pair of electrical conductors electrically connected to the pair of contacts thereof include flexible conductive wires which connect the fourth connector to the housing.

* * * * *

UNITED STATES PATENT AND TRADEMARK OFFICE

CERTIFICATE OF CORRECTION

PATENT NO. : 6,290,543 B1
DATED : September 18, 2001
INVENTOR(S) : Lawrence L. Plummer, Jr. et al.

It is certified that error appears in the above-identified patent and that said Letters Patent is hereby corrected as shown below:

Title page,
Item [56], References Cited, U.S. PATENT DOCUMENTS, refer to 4,290,664: "Davis" should read -- Davis et al. --.

Column 3,
Line 36, "frog" should read -- from --.

Column 4,
Line 33, "side 282" should read -- side $28_2$ --.

Column 6,
Line 7, "protectors go" should read -- protectors 90 --.
Line 20, "interface With" should read -- interface with --.
Line 27, "LEDs 99" should read -- LEDs 98 --.
Line 30, "one or mere" should read -- one or more --.

Column 9,
Lines 57-58, "wherein of the one" should read -- wherein an order of the one --.

Column 10, claim 15,
Line 40, after "at least one of" delete semicolon (;) and insert colon (:).

Signed and Sealed this

Sixteenth Day of April, 2002

*Attest:*

*Attesting Officer*

JAMES E. ROGAN
*Director of the United States Patent and Trademark Office*